US011143009B1

(12) United States Patent
Novak et al.

(10) Patent No.: US 11,143,009 B1
(45) Date of Patent: Oct. 12, 2021

(54) DOWNHOLE THREE PHASE SEPARATOR AND METHOD FOR USE OF SAME

(71) Applicant: Texas Institute of Science, Inc., Richardson, TX (US)

(72) Inventors: Lovrenc Novak, Ljubljana (SI); Martin Petkovsek, Ljubljana (SI); Simon Oman, Ljubljana (SI); Marko Nagode, Ljubljana (SI); Jernej Klemenc, Ljubljana (SI); Franc Madjic, Ljubljana (SI); Marko Hocevar, Ljubljana (SI); Ales Gosar, Ljubljana (SI); Laslo Olah, Richardson, TX (US)

(73) Assignee: Texas Institute of Science, Inc., Richardson, TX (US)

( * ) Notice: Subject to any disclaimer, the term of this patent is extended or adjusted under 35 U.S.C. 154(b) by 0 days.

(21) Appl. No.: 17/341,815

(22) Filed: Jun. 8, 2021

Related U.S. Application Data

(60) Provisional application No. 63/036,990, filed on Jun. 9, 2020.

(51) Int. Cl.
*E21B 43/38* (2006.01)
*E21B 43/12* (2006.01)

(52) U.S. Cl.
CPC ..... *E21B 43/385* (2013.01); *E21B 43/128* (2013.01)

(58) Field of Classification Search
CPC ..... E21B 43/38; E21B 43/385; E21B 43/128
See application file for complete search history.

(56) References Cited

U.S. PATENT DOCUMENTS

| | | | | |
|---|---|---|---|---|
| 4,241,787 | A | 12/1980 | Price | |
| 4,738,779 | A | 4/1988 | Carroll et al. | |
| 4,900,433 | A * | 2/1990 | Dean | E21B 43/36 210/170.11 |
| 5,482,117 | A * | 1/1996 | Kolpak | E21B 43/121 166/105.5 |
| 6,113,675 | A * | 9/2000 | Branstetter | B01D 19/0052 95/261 |
| 6,761,215 | B2 | 7/2004 | Morrison et al. | |
| 7,814,976 | B2 | 10/2010 | Hackworth et al. | |
| 7,823,635 | B2 | 11/2010 | Wright et al. | |
| 9,915,134 | B2 * | 3/2018 | Xiao | F04B 23/04 |
| 10,253,610 | B2 | 4/2019 | Roth et al. | |

(Continued)

*Primary Examiner* — Blake E Michener
(74) *Attorney, Agent, or Firm* — Scott Griggs; Griggs Bergen LLP

(57) ABSTRACT

A downhole separator and method for use of the same for fluid mediums with low viscosity are disclosed. In one embodiment, the downhole separator has a housing with inlet openings that draw a fluid flow into an elongated annular separation chamber within the housing. The fluid flow advances under angular momentum imparted by a rotation of a shaft located in the housing. The shaft includes a profiled surface that imparts drag to the fluid medium and two local pressure increasing units to effect at least partial separation of the fluid medium into the following: (i) a liquid portion upwardly traversing the fluid passageway of the shaft via the inlet ports; (ii) a gaseous portion upwardly traversing the elongated annular separation chamber to the plurality of upper gaseous portion outlets; and (iii) a solid portion downwardly traversing the elongated annular separation chamber to the plurality of lower solid portion outlets.

20 Claims, 4 Drawing Sheets

(56) References Cited

U.S. PATENT DOCUMENTS

| | | | | |
|---|---|---|---|---|
| 10,677,031 | B2 * | 6/2020 | Xiao | E21B 43/38 |
| 2003/0196952 | A1 * | 10/2003 | Kampfen | B04C 5/15 210/512.3 |
| 2005/0217859 | A1 * | 10/2005 | Hartman | E21B 43/38 166/369 |
| 2011/0056698 | A1 | 3/2011 | Talbot et al. | |
| 2011/0146977 | A1 | 6/2011 | Fielder et al. | |
| 2014/0076815 | A1 | 3/2014 | Tan et al. | |
| 2014/0377080 | A1 * | 12/2014 | Xiao | F04B 47/06 417/53 |
| 2018/0283154 | A1 | 10/2018 | De et al. | |

* cited by examiner

DOWNHOLE THREE PHASE SEPARATOR AND METHOD FOR USE OF SAME

PRIORITY STATEMENT & CROSS-REFERENCE TO RELATED APPLICATIONS

This application claims priority from U.S. Provisional Patent Application No. 63/036,990, entitled "Downhole Separator and Method for Use of Same" and filed on Jun. 9, 2020, in the names of Lovrenc Novak et al.; which is hereby incorporated by reference, in entirety, for all purposes.

TECHNICAL FIELD OF THE INVENTION

This invention relates, in general, to downhole separation units or downhole separators and, in particular, to downhole separators for fluid mediums with low viscosity, such as water or light crude oil, during hydrocarbon production from a radially confined space, such as a well, for example.

BACKGROUND OF THE INVENTION

Separation of solid particles and gas from oil is one of the primary measures for increasing the service life of downhole pump units by enabling a stable and efficient production. Typically, downhole gas separators and downhole solid particle separators are designed as two separate units, which are installed in series. The downhole gas separators may be static gas separators or centrifugal gas separators. Static gas separators use passive elements to guide the fluid to achieve separation. As fluid enters a static gas separator, the direction of fluid flow is changed from uphole to downhole in order to separate out the gas from the fluid. Centrifugal gas separators, which are also known as cyclone or rotary-type gas separators, use centrifugal force to separate fluids based on differences in density. Heavier fluid is forced to the outside while gas migrates to the center and is discharged back into the well. A swirling motion is imposed on the fluid by static elements, like the positioning of inlet ports, and moving elements.

Downhole solid particle separators are typically based on similar physical principles as gas separators. A swirling motion is imposed on the inflowing fluid by typically static elements with a helical shape. The solid particles with higher density than the fluid are forced to the outside wall of the separator. Additionally, flow direction is downhole in order to allow particle settling due to gravity. Particles accumulate and may be discharged to a zone below well perforations. Accordingly, there is a need for improved downhole separators that have the benefits of downhole gas separators and downhole solid particle separators, and methods for use of the same, that efficiently operate across different hydrocarbon producing wells over the life of the hydrocarbon producing well.

SUMMARY OF THE INVENTION

It would be advantageous to achieve a downhole separator and method for use of same that would improve upon existing limitations in functionality. It would also be desirable to enable a mechanical-based solution that would provide enhanced operational efficiency across different producing wells or other environments requiring the removal of fluid mediums with low viscosity, such as water or light crude oil. Further, it is desirable to increase functionality with aspects of downhole gas separators and downhole solid particle separators. To better address one or more of these concerns, a downhole separator and method for use of the same are disclosed. In one aspect, some embodiments include the downhole separator having a housing with inlet openings that draw a flow of the fluid medium into an elongated annular separation chamber within the housing. The fluid flow advances under angular momentum imparted by a rotation of a shaft located in the housing. The shaft includes a profiled surface that imparts drag to the fluid medium and at least one local pressure increasing unit to effect at least partial separation of the fluid medium into the following: (i) a liquid portion upwardly traversing a fluid passageway of the shaft via inlet ports; (ii) a gaseous portion upwardly traversing the elongated annular separation chamber to the upper gaseous portion outlets; and (iii) a solid portion downwardly traversing the elongated annular separation chamber to the lower solid portion outlets. Some embodiments include two local pressure increasing units, which may be located in an upper position and a lower position. Whether at least one or two local pressure increasing units are utilized, each of the local pressure increasing units may be an auger, helical rotor, radial impeller, diagonal impeller, or the like, for example.

In another aspect, the housing of the downhole separator includes an upper transfer assembly in an upper end of the housing and the upper transfer assembly transfers rotational torque of the shaft of the downhole separator to an upper rotating body. The upper rotating body is located suprajacent to the housing and the upper rotating body may be a pump unit shaft belonging to a pump unit. A lower transfer assembly in a lower end of the housing transfers rotational torque of a lower rotating body to the shaft. The lower rotating body is located subjacent to the housing and the lower rotating body may be a motor shaft belonging to a drive unit. The motor shaft of the drive unit, the shaft of the downhole separator, and the pump unit shaft of the pump unit rotate together under the power of the drive unit. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
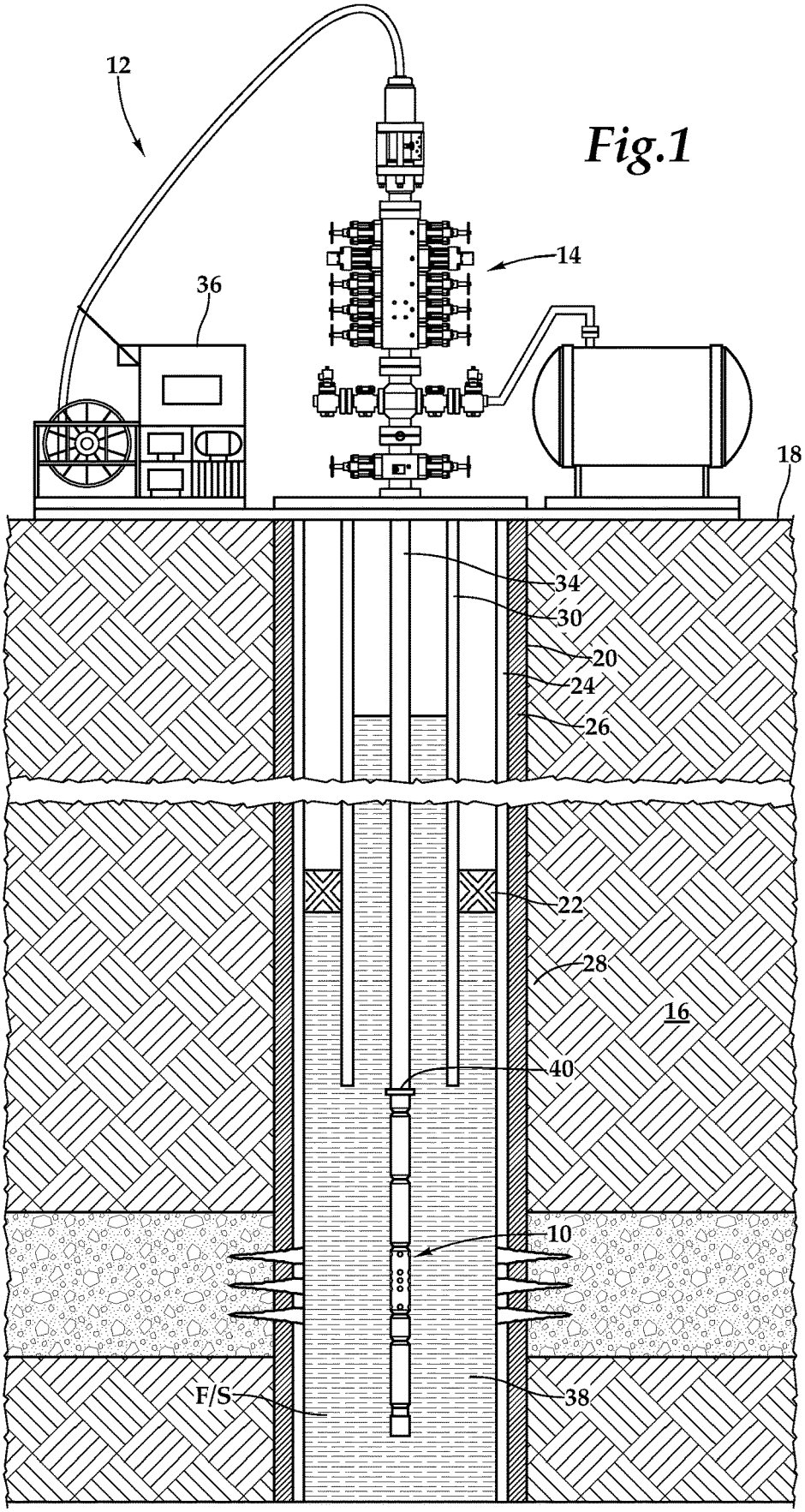
FIG. 1 is a schematic illustration depicting one embodiment of an onshore hydrocarbon production operation employing a downhole separator unit, according to the teachings presented herein.

Referring initially to FIG. 1, therein is depicted one embodiment of a downhole separator 10 being employed in an onshore hydrocarbon production operation 12, which may be producing oil, gas, or a combination thereof, for example. A wellhead 14 is positioned over a subterranean hydrocarbon formation 16, which is located below a surface 18. A wellbore 20 extends through the various earth strata including the subterranean hydrocarbon formation 16. A casing string 24 lines the wellbore 20 and the casing string 24 is cemented into place with cement 26. Perforations 28 provide fluid communication from the subterranean hydrocarbon formation 16 to an interior of the wellbore 20. A packer 22 provides a fluid seal between a production tubing 30 and the casing string 24. Composite coiled tubing 34, which is a type of the production tubing 30, runs from the surface 18, wherein various surface equipment 36 is located, to a fluid accumulation zone 38 containing a fluid medium F having a low viscosity, such as hydrocarbons like oil or gas, fracture fluids, water, or a combination thereof. As indicated, the fluid medium F may include solid particles S. As shown, the downhole separator 10 is coupled to a lower end 40 of the composite coiled tubing 34.

Figure 2:
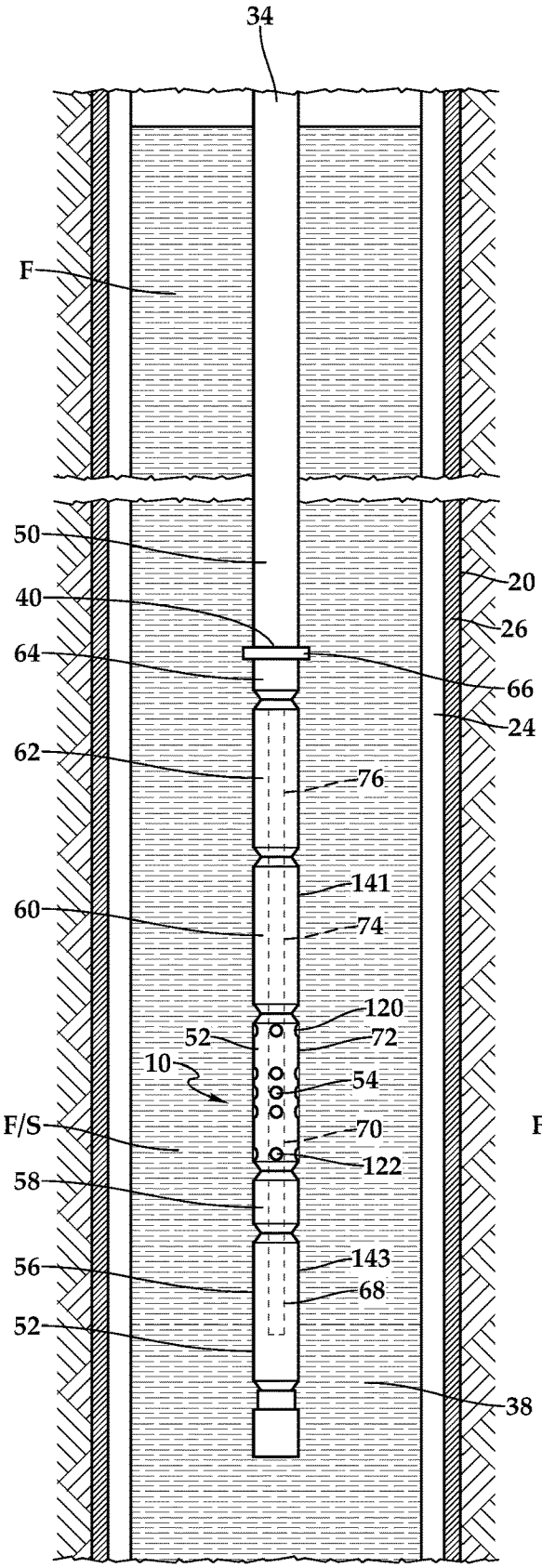
FIG. 2 is a schematic illustration depicting one embodiment of the onshore hydrocarbon production operation of FIG. 1 in a first stage of removing a fluid medium with low viscosity in the presence of solid particles.
Figure 3:
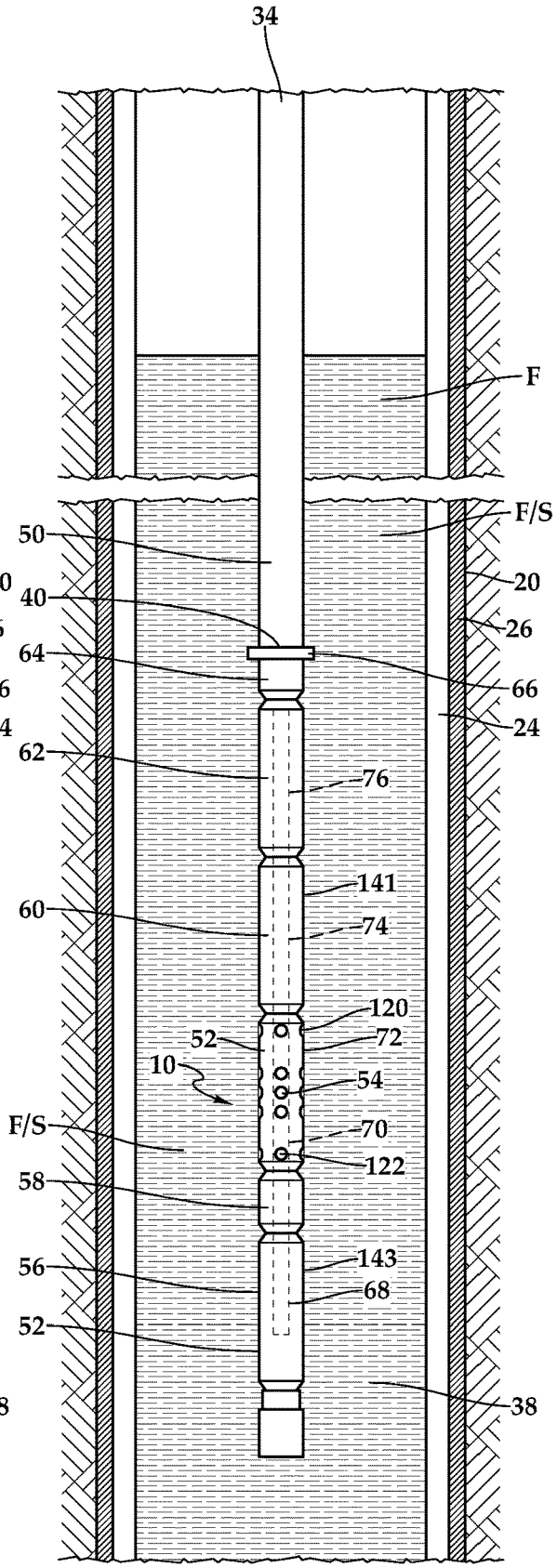
FIG. 3 is a schematic illustration depicting one embodiment of the onshore hydrocarbon production operation of FIG. 1 in a second stage of removing a fluid medium with low viscosity in the presence of solid particles.

Referring now to FIG. 2 and FIG. 3, as shown, the downhole separator 10 is positioned in the fluid accumulation zone 38 defined by the casing string 24 cemented by the cement 26 within the wellbore 20. The downhole separator 10 is incorporated into a downhole tool 50 connected to the lower end 40 of the composite coiled tubing 34 and, more particularly, the downhole separator 10 includes a housing 52 having various ports 54 and is supraposed to a drive unit 56 coupled by a coupling unit 58 to the downhole separator 10. The downhole separator 10 is subjacently connected to serially positioned pump units 60, 62, which are, in turn, coupled to an intervention unit 64 and a connector 66. The various ports 54 of the downhole separator 10 may be assigned various inlet or outlet functions or be sealed shut. It should be appreciated that a variety of downhole tool configurations may be employed and number of pump units and subs, may vary depending on the particular application that the downhole separator 10 is assigned. As will be discussed in further detail hereinbelow, a motor shaft 68 of the drive unit 56, a shaft 70 of the downhole separator 10, a pump unit shaft 72 of the pump unit 60, and a pump unit shaft 74 of the pump unit 62 may rotate together under the power of the drive unit 56. In such an arrangement, the downhole separator 10 includes modularity to provide multiple components in a serial arrangement with the utilization of a common shaft 76 driven by a single drive unit, such as the drive unit 56.

In operation, to begin the processes of transferring the fluid medium having solid particles F/S, the downhole tool 50 with the downhole separator 10 is positioned in the fluid accumulation zone 38. Initially, as shown best in FIG. 2, the downhole tool 50 and the downhole separator 10 are completely submerged in the fluid medium having solid particles F/S, which, as mentioned, may include hydrocarbons such as oil and/or gas, fracture fluid, water, or combinations thereof with various solid particles. The downhole separator 10 is actuated and selective operation of one or more of the pump units 60, 62 begins. As time progresses, as shown best in FIG. 3, the downhole separator 10 effects at least partial separation of the fluid medium having solid particles F/S into (i) a liquid portion upwardly traversing the downhole separator 10 to the pump units 60, 62; (ii) a gaseous portion upwardly traversing the downhole separator 10 separately from the liquid portion; and (iii) a solid portion downwardly traversing the downhole separator 10.

It should be appreciated that in instances where the downhole separator 10 is operating in a fluid medium F with no solid particles or nominal solid particles present, the downhole separator 10 effects at least partial separation of the fluid medium into (i) a liquid portion upwardly traversing the downhole separator 10 to the pump units 60, 62; and (ii) a gaseous portion upwardly traversing the downhole separator 10 separately from the liquid portion. It should therefore be appreciated that the downhole separator 10 of the teachings presented herein may be a three-phase separator or a two-phase separator.

Figure 4:
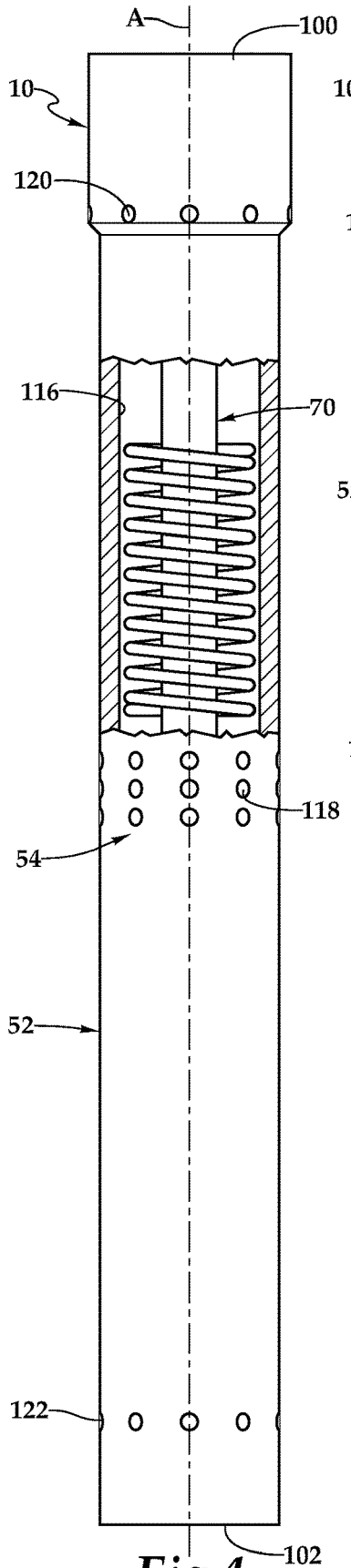
FIG. 4 is a side elevation view of one embodiment of the downhole separator, partially sectioned, depicted in FIG. 1 through FIG. 3.
Figure 5:
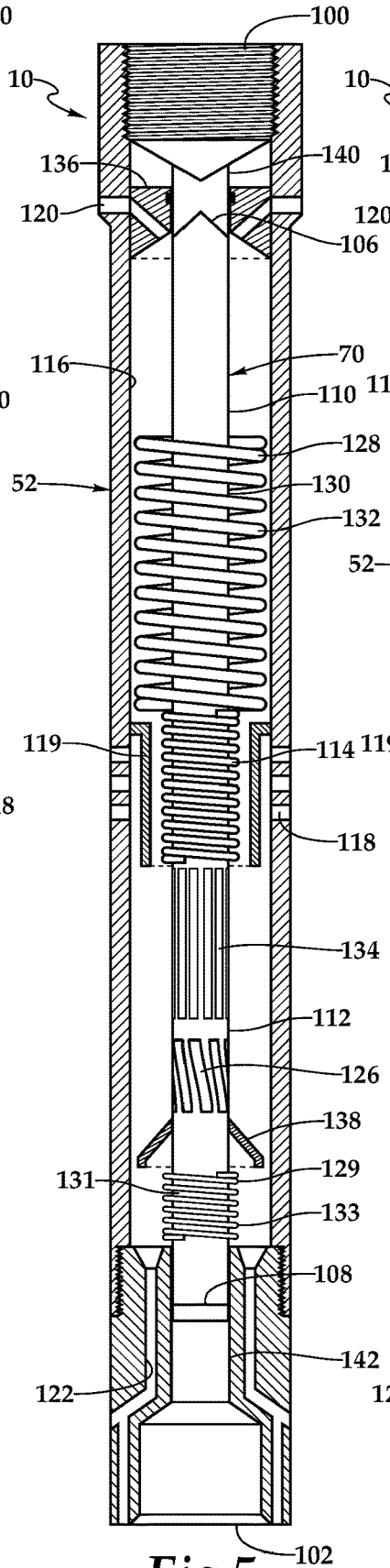
FIG. 5 is a longitudinal sectional view of the downhole separator depicted in FIG. 4.
Figure 6:
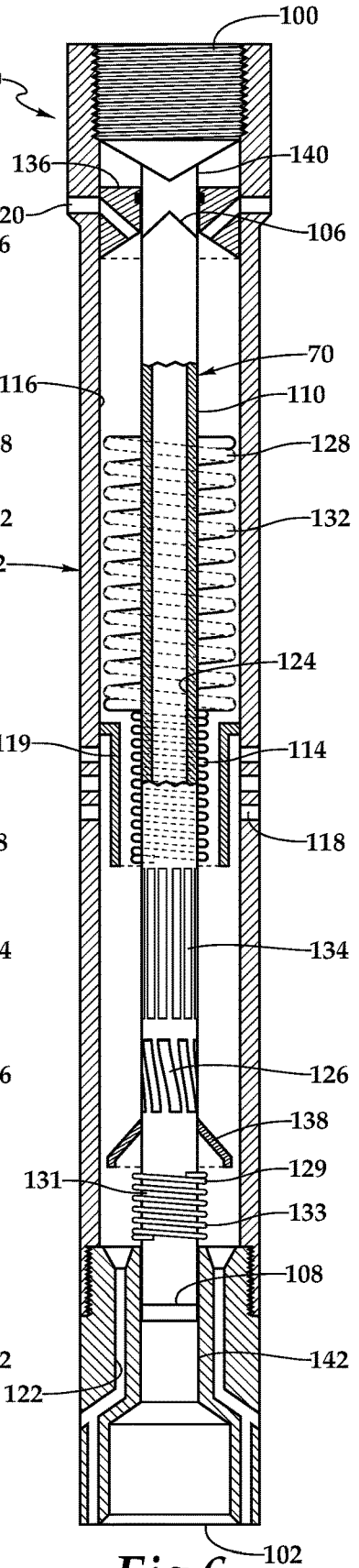
FIG. 6 is a longitudinal sectional view, partially sectioned, of the downhole separator depicted in FIG. 4.

Referring now to FIG. 4, FIG. 5, and FIG. 6, one embodiment of the downhole separator 10 for imparting separation to a fluid medium having solid particles (please see F/S in FIGS. 1-3 and 7-8) with low viscosity is depicted in additional detail. The housing 52 has an upper end 100 and a lower end 102 with a vertical axis A therethrough. The shaft 70 is coaxially located with the vertical axis A within the housing 52. The shaft 70 has an upper terminus 106 proximate the upper end 100 and a lower terminus 108 proximate the lower end 102. As shown, the shaft 70 includes an upper portion 110 proximate the upper terminus 106. A lower portion 112 is proximate the lower terminus 108. Lastly, a middle portion 114 is interposed between the upper portion 110 and the lower portion 112. An elongated annular separation chamber 116 is defined between the housing 52 and the shaft 70.

The ports 54 include inlet openings 118 in the housing 52 which may be located in the housing 52 proximate the middle portion 114 of the shaft 70. A shield 119 may be positioned between the inlet openings 118 and the shaft 70 proximate the middle portion 114 of the shaft 70. The ports 54 may also include upper gaseous portion outlets 120 in the housing 52 proximate the upper end 100. The upper gaseous portion outlets 120 are disposed in fluid communication with the elongated annular separation chamber 116. The ports 54 may further include lower solid portion outlets 122 in the housing 52 proximate the lower end 102. The lower solid portion outlets 122 are disposed in fluid communication with the elongated annular separation chamber 116.

In one embodiment, the shaft 70 is hollow with a fluid passageway 124 therethrough. Inlet ports 126 provide fluid communication from the elongated annular separation chamber 116 to the fluid passageway 124. The inlet ports 126 may be positioned on the lower portion 112 of the shaft 70. An upper local pressure increasing unit 128 may be coaxially and rotatably disposed on the upper portion 110 of the shaft 70. In one implementation, the upper local pressure increasing unit 128 may include a central axial spindle 130 coaxially aligned with the vertical axis A. As illustrated, the central axial spindle 130 is surrounded by helical flights 132 which when rotating about the axis A provide the lift to the fluid medium and consequently provide the local pressure increase needed to extract the solid-depleted/liquid-depleted gaseous portion of the fluid medium from the separation chamber 116 to the fluid accumulation zone 38. A lower local pressure increasing unit 129 may be coaxially and rotatably disposed on the lower portion 112 of the shaft 70. In one implementation, the lower local pressure increasing unit 129 may include a central axial spindle 131 coaxially aligned with the vertical axis A. As illustrated, the central axial spindle 131 is surrounded by helical flights 133 which when rotating about the axis A provide the downward movement to the fluid medium and consequently provide the local pressure increase needed to extract the gas-depleted/liquid-depleted solid portion of the fluid medium from the separation chamber 116 to the fluid accumulation zone 38. In some embodiments, the shaft 70 includes a profiled surface 134 that imparts drag to the fluid medium to achieve the desired amount of centrifugal force. The profiled surface 134 may be located at the middle portion 114 of the shaft 70. The profiled surface 134 provides the rotating shaft 70 with a specially designed geometry and surface roughness to ensure the precise amount of drag between the shaft 70 and a liquid L to achieve right amount of centrifugal force.

A gas flow rectifier 136 may be interposed between the elongated annular separation chamber 116 and the upper gaseous portion outlets 120. The gas flow rectifier 136 may have an annular form and the gas flow rectifier 136 functions to further separate gas from the fluid medium. Also, a solid trap and flow moderator 138 may be interposed between the elongated annular separation chamber 116 and the lower solid portion outlets 122. The solid trap and flow moderator 138 may have an annular form and the solid trap and flow moderator 138 functions to further separate solids from the fluid medium.

An upper transfer assembly 140 may be positioned in the upper end 100 of the housing 52 and rotatably coupled to the shaft 70. The upper transfer assembly 140 transfers rotational torque of the shaft 70 to an upper rotating body 141, which may be located suprajacent to the housing 52. At the other end of the housing 52, a lower transfer assembly 142 may be positioned at the lower end 102 and rotatably coupled to the shaft 70. The lower transfer assembly 142 transfers rotational torque of a lower rotating body 143 to the shaft 70. The lower rotating body 143 may be located subjacent to the housing 52. In some embodiments, the upper rotating body 141 is the pump unit shaft 74 belonging to the pump unit 60 and the lower rotating body 143 is the motor shaft 68 belonging to drive unit 56. In these implementations, the motor shaft 68, the shaft 70, and the pump unit shaft 72 rotating together under the power of the drive unit 56, which is essentially providing power to the common shaft 76. In this manner, the shaft 70 has a double function; namely, transferring torque from the drive unit 56 below the downhole separator 10 to the pumping unit 60 above the downhole separator 10 and to transferring liquid L in the form of separated crude oil from solid particles D and gas G to the pumping unit 60.

Figure 7:
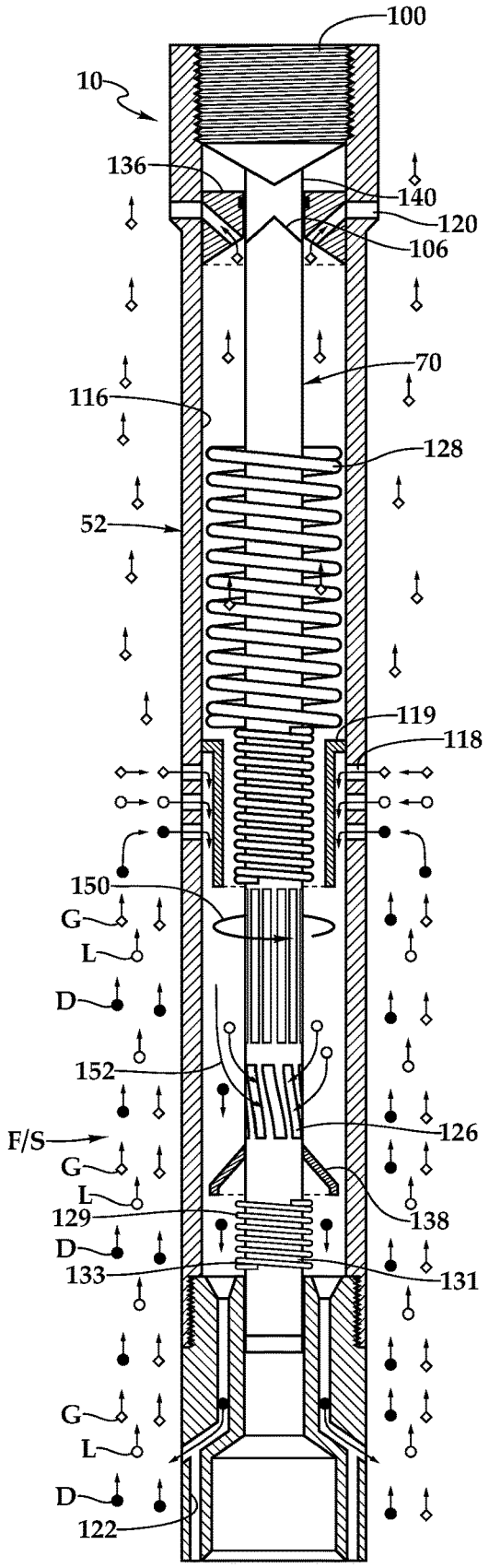
FIG. 7 is a longitudinal sectional view of the downhole separator depicted in FIG. 4 during a separation operation.
Figure 8:
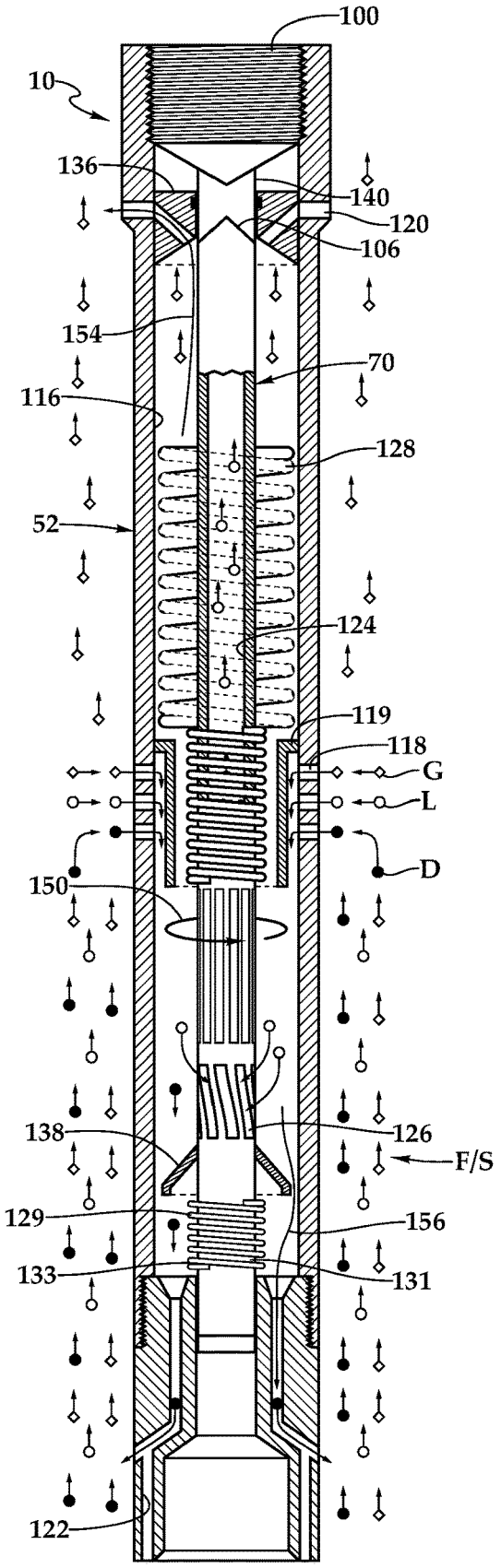
FIG. 8 is a longitudinal sectional view, partially sectioned, of the downhole separator depicted in FIG. 4 during the separation operation.

Referring now of FIG. 7 and FIG. 8, one operational embodiment of the downhole separator 10 for imparting separation to a fluid medium F with low viscosity is depicted in additional detail. As shown, the fluid medium having solid particles F/S includes liquid L, gas G, and solid particles D. The inlet openings 118 draw a flow of the fluid medium having solid particles F/S into the elongated annular separation chamber 116 within the housing 52. The shield 119 divides the intake flow at the inlet openings 118, which is proceeding downward along the shaft 70, from the already separated gas G traversing the elongated annular separation chamber 116 along the shaft 70 to the upper gaseous portion outlets 120. That is, the shield 119 mitigates or prevents the mixing of these two flow mediums.

The flow of the fluid medium with the solid particles F/S advances under angular momentum imparted by a rotation 150 of the shaft 70 and its profiled surface 134 to effect at least partial separation of the fluid medium having solid particles F/S. The rotary frequency control of the shaft 70 provides a high separation efficiency in a wide range of flow conditions. The separation may include a solid-depleted/gas-depleted liquid portion upwardly traversing the fluid passageway of the shaft via the inlet ports 126, as shown by an arrow 152. From the fluid passageway, the solid-depleted/gas-depleted liquid portion may travel to another component of the downhole tool 50, such as the pump unit 60.

The separation may also include a solid-depleted/liquid-depleted gaseous portion upwardly traversing the elongated annular separation chamber 116 through the gas flow rectifier 136 to the upper gaseous portion outlets 120, as shown by an arrow 154. From the upper gaseous portion outlets 120, the solid-depleted/liquid-depleted gaseous portion may travel to another component of the downhole tool 50 or be appropriately discharged into the wellbore 20. The separation may also include a liquid-depleted/gas-depleted solid portion downwardly traversing the elongated annular separation chamber 116 through the solid trap and flow moderator 138 to the lower solid portion outlets 122, as shown by an arrow 156. From the lower solid portion outlets 122, liquid-depleted/gas-depleted solid portion may travel to another component of the downhole tool 50 or be appropriately discharged into the wellbore 20.

Referring to FIG. 1 through FIG. 8, the downhole separator 10 presented herein functions to separate fluid medium F with low viscosity, such as water or light crude oil, for example. As discussed, the fluid medium F may also have solid particles therein. As also discussed, the downhole separator 10 provides for installation in confined spaces such as pipes, below or above the ground level, near or at a remote location. Optionally, the downhole separator 10 may be utilized with other downhole tools, such as pump units, sensors, and measuring devices, for example.

The downhole separator 10 presented herein separates gas G and solid particles D from the liquid L in the fluid medium F in order to assure high efficiency and long-life span of the pump unit or pump units, like the pump units 60, 62, being utilized in conjunction with the downhole separator 10. The design of the downhole separator 10 allows the installation of the drive unit 56 below the downhole separator 10 in order to achieve better cooling of the drive unit 56, since the drive unit will be submerged in the fluid medium F or fluid medium having solid particles F/S. By exploiting the design having the drive unit 56 below the downhole separator 10, an active separation process is achieved by, in part, controlling the rotation and associated rotational frequency of the shaft 70. The fluid medium having solid particles F/S, which may be a crude medium, enters the downhole separator 10 through the well casing string 24 through the inlet openings 118. In some embodiments, above the inlet openings 118, a certain length of the downhole separator 10 serves to trap gas G from where it is expelled from the separator by action of the upper local pressure increasing unit 128, which may be located on an upper portion of the shaft 70. The fluid medium having solid particles F/S flows downstream through the elongated annular separation chamber 116 into the inlet ports 126 of the shaft 70. Gas G is partially separated from the fluid medium having solid particles F/S already in the elongated annular separation chamber 116 due to lift. The separation process also utilizes centrifugal forces, created by rotating the shaft 70. The centrifugal forces push solid particles D with higher density from the fluid medium having solid particles F/S against the housing 52 within the elongated annular separation chamber 116, while gas G is moved to in the vicinity of the shaft 70 within elongated annular separation chamber 116. Solid particles D move to an outer radius of the elongated annular separation chamber 116, where the tangential and radial velocity of the solid particles D drops. Solid particles D move due to gravity and flow downstream through the elongated annular separation chamber 116 and are trapped at the bottom of the downhole separator 10 at the solid trap and flow moderator 138, where solid particles D leave the downhole separator 10 via the lower solid portion outlets 122 to another component or into the wellbore 20. The extraction is provided by the lower local pressure increasing unit 129 which may be located on a lower portion of the shaft 70.

The helical flights 132 of the upper local pressure increasing unit 128 help to lift the gas G upstream to the gas flow rectifier 136, where the gas G leaves the downhole separator 10 via upper gaseous portion outlets 120 to another component or into the fluid accumulation zone 38. The helical flights 132 may have the form of specially designed spiral rotor vanes to increase pressure for the release of gas G. Separated fluid medium in the form of liquid L enters the shaft 70 through the inlet ports 126, which are configured to prevent high turbulence conditions at the vicinity of the inlet ports 126. Moreover, the profiled surface 134 may be a specially designed shaft textured surface that ensures the precise centrifugal force to separate the solid particles D from the liquid L causing minimal flow losses. By way of further example, the profiled surface 134 may be or include radial wings imparting drag to the fluid medium.

That is, the shaft 70 includes the profiled surface 134 that imparts drag to the fluid medium, which may have solid particles F/S, and at least one local pressure increasing unit, such as the upper local pressure increasing unit 128 and/or the lower local pressure increasing unit 129 to effect at least partial separation of the fluid medium into the following: (i) a liquid portion upwardly traversing a fluid passageway of the shaft via inlet ports 126; (ii) a gaseous portion upwardly traversing the elongated annular separation chamber 116 to the upper gaseous portion outlets 120; and (iii) a solid portion downwardly traversing the elongated annular separation chamber 116 to the lower solid portion outlets 122. Some embodiments include two local pressure increasing units, which may be located in an upper position and a lower position. Whether at least one or two local pressure increasing units are utilized, each of the local pressure increasing units may be an auger, helical rotor, radial impeller, diagonal impeller, or the like, for example.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole separator for imparting separation to a fluid medium, the downhole separator comprising:

a housing having an upper end and a lower end, the housing having a vertical axis therethrough;

a shaft coaxially located with the vertical axis within the housing, the shaft having an upper terminus proximate the upper end and a lower terminus proximate the lower end, the shaft including an upper portion proximate the upper terminus, a lower portion proximate the lower terminus, and a middle portion interposed between the upper portion and the lower portion;

an elongated annular separation chamber defined between the housing and the shaft;

the shaft being hollow with a fluid passageway therethrough, the shaft having a plurality of inlet ports providing fluid communication from the elongated annular separation chamber to the fluid passageway;

an upper local pressure increasing unit coaxially and rotatably disposed on the upper portion of the shaft;

a lower local pressure increasing unit coaxially and rotatably disposed on the lower portion of the shaft;

an upper transfer assembly in the upper end of the housing, the upper transfer assembly transferring rotational torque of the shaft to an upper rotating body, the upper rotating body being located suprajacent to the housing;

a lower transfer assembly in the lower end of the housing, the lower transfer assembly transferring rotational torque of a lower rotating body to the shaft, the lower rotating body being located subjacent to the housing;

a plurality of inlet openings in the housing;

a plurality of upper gaseous portion outlets in the housing proximate the upper end, the upper gaseous portion outlets being disposed in fluid communication with the elongated annular separation chamber;

a plurality of lower solid portion outlets in the housing proximate the lower end, the lower solid portion outlets being disposed in fluid communication with the elongated annular separation chamber;

the plurality of inlet openings drawing a flow of the fluid medium into the elongated annular separation chamber within the housing, the fluid flow advancing under angular momentum imparted by a rotation of the shaft having a profiled surface to effect at least partial separation of the fluid medium into a solid-depleted/gas-depleted liquid portion upwardly traversing the fluid passageway of the shaft via the inlet ports, a solid-depleted/liquid-depleted gaseous portion upwardly traversing the elongated annular separation chamber by action of the upper local pressure increasing unit to the plurality of upper gaseous portion outlets, and a liquid-depleted/gas-depleted solid portion downwardly traversing the elongated annular separation chamber by action of the lower local pressure increasing unit to the plurality of lower solid portion outlets.

2. The downhole separator as recited in claim 1, further comprising a gas flow rectifier interposed between the elongated annular separation chamber and the plurality of upper gaseous portion outlets.

3. The downhole separator as recited in claim 1, further comprising a solid trap and flow moderator interposed between the elongated annular separation chamber and the plurality of lower solid portion outlets.

4. The downhole separator as recited in claim 1, wherein the profiled surface further comprises radial wings imparting drag to the fluid medium.

5. The downhole separator as recited in claim 4, wherein the profiled surface is located at the middle portion of the shaft.

6. The downhole separator as recited in claim 1, wherein the plurality of inlet ports are positioned on the lower portion of the shaft.

7. The downhole separator as recited in claim 1, wherein the upper local pressure increasing unit further comprises a device selected from the group consisting of augers, helical rotors, radial impellers, and diagonal impellers.

8. The downhole separator as recited in claim 1, wherein the lower local pressure increasing unit further comprises a device selected from the group consisting of augers, helical rotors, radial impellers, and diagonal impellers.

9. The downhole separator as recited in claim 1, wherein the upper local pressure increasing unit further comprises a central axial spindle coaxially aligned with the vertical axis, the central axial spindle being surrounded by helical flights which impart angular momentum upon rotation to the fluid medium.

10. The downhole separator as recited in claim 1, wherein the lower local pressure increasing unit further comprises a central axial spindle coaxially aligned with the vertical axis, the central axial spindle being surrounded by helical flights which impart angular momentum upon rotation to the fluid medium.

11. The downhole separator as recited in claim 1, wherein the plurality of inlet openings are located in the housing proximate the middle portion of the shaft.

12. The downhole separator as recited in claim 1, wherein the upper rotating body further comprises a pump unit shaft.

13. The downhole separator as recited in claim 1, wherein the lower rotating body further comprises a motor shaft.

14. The downhole separator as recited in claim 1, wherein the upper rotating body further comprises a pump unit shaft and the lower rotating body further comprises a motor shaft, the motor shaft, the shaft, and the pump unit shaft rotating together.

15. A downhole separator for imparting separation to a fluid medium, the downhole separator comprising:

a housing having an upper end and a lower end, the housing having a vertical axis therethrough;

a shaft coaxially located with the vertical axis within the housing, the shaft having an upper terminus proximate the upper end and a lower terminus proximate the lower end, the shaft including an upper portion proximate the upper terminus, a lower portion proximate the lower terminus, and a middle portion interposed between the upper portion and the lower portion;

an elongated annular separation chamber defined between the housing and the shaft;

the shaft being hollow with a fluid passageway therethrough, the shaft having a plurality of inlet ports providing fluid communication from the elongated annular separation chamber to the fluid passageway;

an upper local pressure increasing unit coaxially and rotatably disposed on the upper portion of the shaft;

a lower local pressure increasing unit coaxially and rotatably disposed on the lower portion of the shaft;

an upper transfer assembly in the upper end of the housing, the upper transfer assembly transferring rotational torque of the shaft to an upper rotating body, the upper rotating body being located suprajacent to the housing;

a lower transfer assembly in the lower end of the housing, the lower transfer assembly transferring rotational torque of a lower rotating body to the shaft, the lower rotating body being located subjacent to the housing;

a plurality of inlet openings in the housing;

a plurality of upper gaseous portion outlets in the housing proximate the upper end, the upper gaseous portion outlets being disposed in fluid communication with the elongated annular separation chamber;

a plurality of lower solid portion outlets in the housing proximate the lower end, the lower solid portion outlets being disposed in fluid communication with the elongated annular separation chamber;

the plurality of inlet openings drawing a flow of the fluid medium into the elongated annular separation chamber within the housing, the fluid flow advancing under angular momentum imparted by a rotation of the shaft having a profiled surface to effect at least partial separation of the fluid medium into a gas-depleted liquid portion upwardly traversing the fluid passageway of the shaft via the inlet ports, and a liquid-depleted gaseous portion upwardly traversing the elongated annular separation chamber to the plurality of upper gaseous portion outlets.

16. The downhole separator as recited in claim 15, wherein the upper rotating body further comprises a pump unit shaft.

17. The downhole separator as recited in claim 15, wherein the lower rotating body further comprises a motor shaft.

18. A downhole separator for imparting separation to a fluid medium with, the downhole separator comprising:

a housing having an upper end and a lower end, the housing having a vertical axis therethrough;

a shaft coaxially located with the vertical axis within the housing, the shaft having an upper terminus proximate the upper end and a lower terminus proximate the lower end, the shaft including an upper portion proximate the upper terminus, a lower portion proximate the lower terminus, and a middle portion interposed between the upper portion and the lower portion;

an elongated annular separation chamber defined between the housing and the shaft;

the shaft being hollow with a fluid passageway therethrough, the shaft having a plurality of inlet ports providing fluid communication from the elongated annular separation chamber to the fluid passageway;

an upper local pressure increasing unit coaxially and rotatably disposed on the upper portion of the shaft;

a lower local pressure increasing unit coaxially and rotatably disposed on the lower portion of the shaft;

a plurality of inlet openings in the housing;

a plurality of upper gaseous portion outlets in the housing proximate the upper end, the upper gaseous portion outlets being disposed in fluid communication with the elongated annular separation chamber;

a plurality of lower solid portion outlets in the housing proximate the lower end, the lower solid portion outlets being disposed in fluid communication with the elongated annular separation chamber;

the plurality of inlet openings drawing a flow of the fluid medium into the elongated annular separation chamber within the housing, the fluid flow advancing under angular momentum imparted by a rotation of the shaft having a profiled surface to effect at least partial separation of the fluid medium into the following: (i) a liquid portion upwardly traversing the fluid passageway of the shaft via the inlet ports; (ii) a gaseous portion upwardly traversing the elongated annular separation chamber to the plurality of upper gaseous portion outlets; and (iii) a solid portion downwardly traversing the elongated annular separation chamber to the plurality of lower solid portion outlets.

19. The downhole separator as recited in claim 18, further comprising a gas flow rectifier interposed between the elongated annular separation chamber and the plurality of upper gaseous portion outlets.

20. The downhole separator as recited in claim 18, further comprising a solid trap and flow moderator interposed between the elongated annular separation chamber and the plurality of lower solid portion outlets.

* * * * *